United States Patent [19]

Fogel

[11] 3,931,888

[45] Jan. 13, 1976

[54] ARTICLE CARRIER

[75] Inventor: Wesley Samuel Fogel, Quebec, Canada

[73] Assignee: Dominion Glass Company Limited, Montreal, Canada

[22] Filed: Oct. 31, 1974

[21] Appl. No.: 519,743

[52] U.S. Cl. ..... 206/434; 206/426; 229/40

[51] Int. Cl.[2] ..... B65D 65/10

[58] Field of Search ..... 206/434, 426, 427, 429; 229/28 R, 39 B, 40, 29 R, 29 B, 29 C, 37 E

[56] References Cited

UNITED STATES PATENTS

| | | | |
|---|---|---|---|
| 3,078,988 | 2/1963 | Dunning | 206/429 |
| 3,503,498 | 3/1970 | Lawrence | 206/427 |
| 3,598,302 | 8/1971 | Nowak | 229/28 R |
| 3,720,366 | 3/1973 | Martin | 229/37 E |
| 3,854,580 | 12/1974 | Hennessey | 206/426 |

*Primary Examiner*—William T. Dixson, Jr.
*Assistant Examiner*—Stephen P. Garbe

[57] ABSTRACT

An article carrier having two opposed open sides. The carrier comprises a bottom and a top wall spaced apart in substantially parallel relationship by two transverse walls extending between opposed end edges of the bottom and top wall. An article retaining panel extends from a respective side edge of both the bottom and top wall and inclined inwardly between the bottom and top wall. Article retaining cavities are formed in each of the article retaining panels and defined retention ribs therebetween. The cavities in the panels are in transverse alignment with cavities in an opposite retaining panel whereby an article may be removably secured between vertically aligned pairs of cavities by frictional engagement by the ribs and by a pressure applying panel applying inward pressure between the ends of the article.

10 Claims, 3 Drawing Figures

FIG. 1
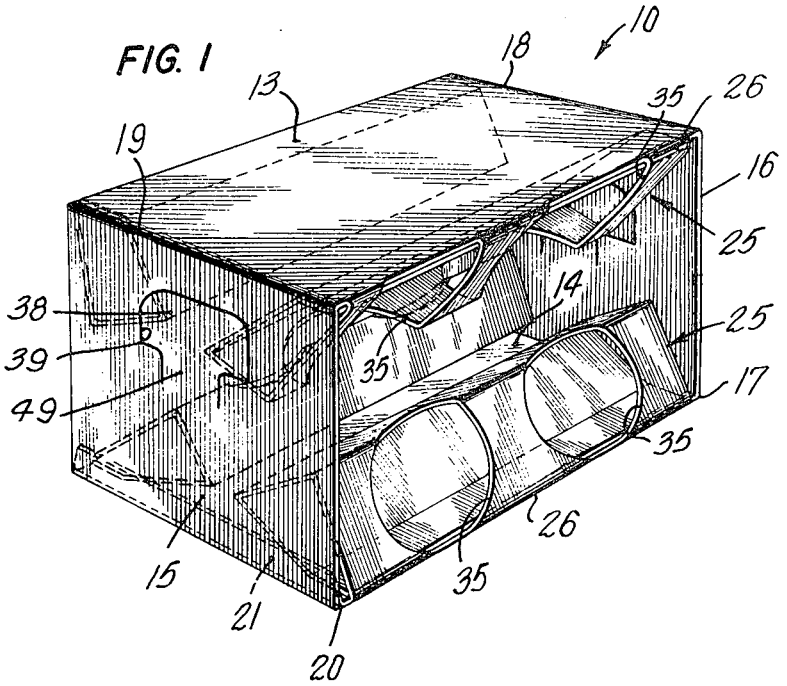
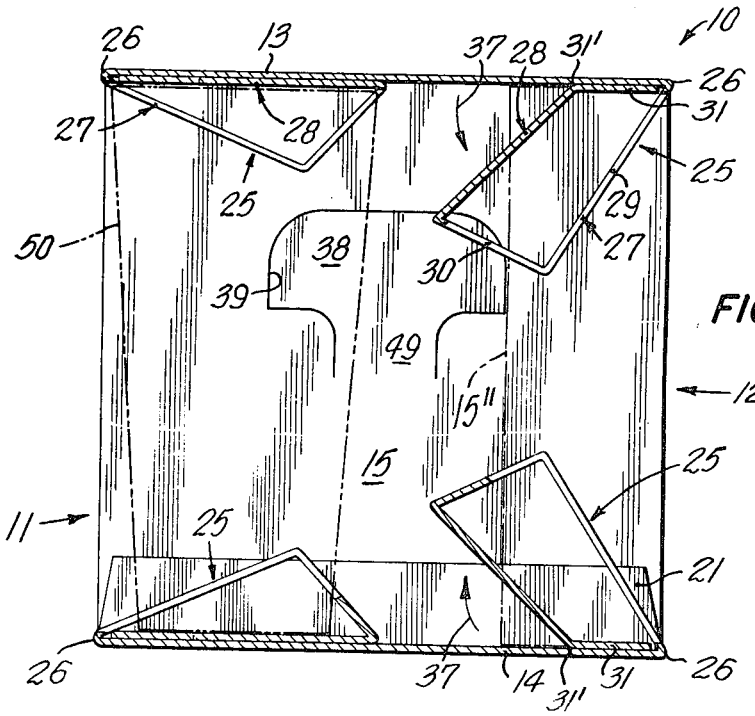
FIG. 3

ARTICLE CARRIER

BACKGROUND OF THE INVENTION

1. Field of the Invention

This invention relates to article carriers and generally and more particularly to an improved article carrier of the type commonly used to transport articles, such as glasses, and which carrier is open from two opposed sides whereby to provide a see-through package.

2. Description of the Prior Art

Article carriers of the general type to which this application relates are generally made of different shapes, sizes and formed from cardboard or other foldable type paper material. These type carriers normally comprise a single sheet of cardboard material disposed along the top and bottom wall where the majority of the weight of the article is distributed. Still further, prior art carriers of this general type require expensive machinery to form the carrier and normally requires the assistance of an operator in order to form the package. Furthermore, known carriers of this general type are subject to destruction when the articles carried therein are removed from the package. Accordingly, with the majority of these carriers it is not possible to remove the article then place it back into the package and wherein the package will again snugly hold the article.

SUMMARY OF THE INVENTION

It is a feature of the present invention to provide an improved article carrier which is transportable, easily and automatically manufactured and assembled, and which is of the see-through type.

Accordingly, from a broad aspect, the present invention provides an article carrier having two opposed open sides. The carrier comprises a bottom and a top wall spaced apart in substantially parallel relationship by two transverse walls extending between opposed end edges of the bottom and top wall. An article retaining panel extends from a respective side edge of both the bottom and top wall and inclined inwardly between the bottom and top wall. Article retaining cavities are formed in each of the article retaining panels and define retention ribs therebetween. The cavities in the panels are in substantially transverse alignment with cavities in an opposite retaining panel whereby an article may be removably secured between vertically aligned pairs of cavities by frictional engagement by the ribs and by panel means forming part of the article retaining panel and applying inward pressure between the ends of the article.

BRIEF DESCRIPTION OF THE DRAWINGS

A preferred embodiment of the present invention will now be described with reference to the accompanying drawings in which:

FIG. 1 is a perspective view showing the article carrier of the present invention;

FIG. 3 is a sectional view of the article carrier illustrating the manner in which articles are secured by the article retaining panels.

DESCRIPTION OF THE PREFERRED EMBODIMENTS

Figure 2:
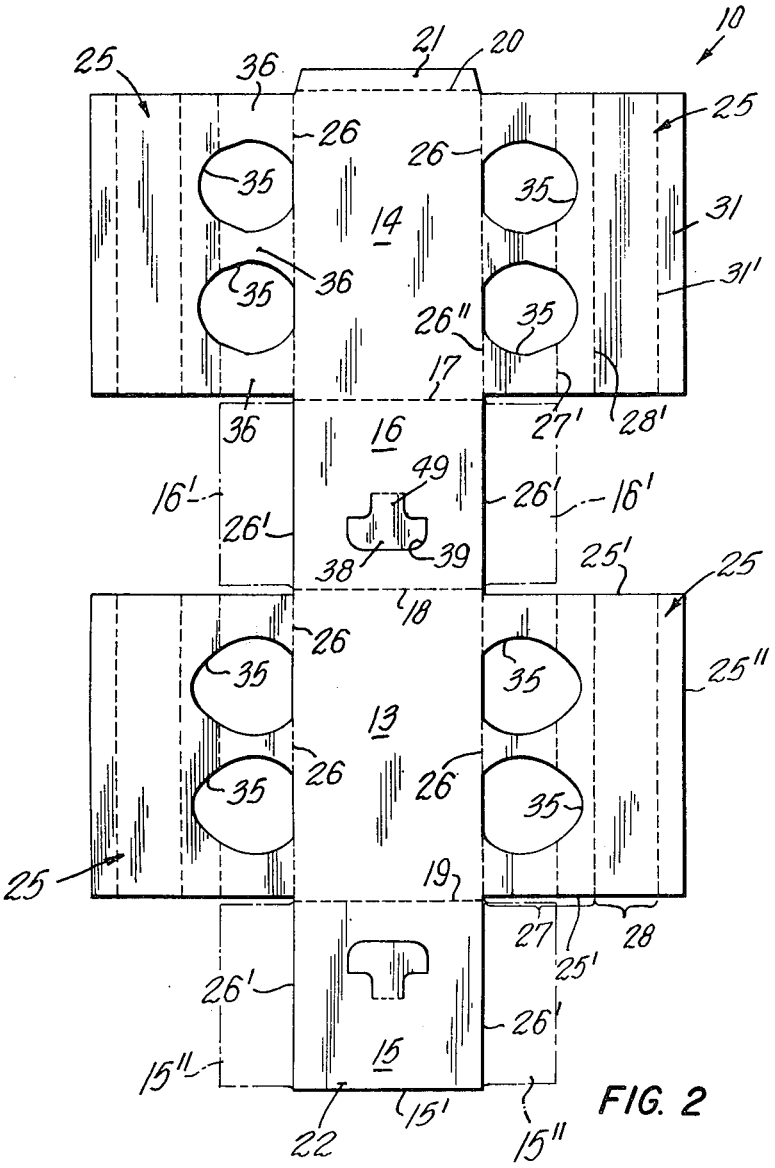
FIG. 2 is a plan view of the blank forming the article carrier of the present invention.

Referring now to the drawings, there is shown generally at 10, the article carrier of the present invention.

The article carrier is formed with two opposed open sides 11 and 12 as shown in FIG. 3. The carrier comprises a bottom wall 14 and a top wall 13 which are spaced apart in substantially parallel relationship by two transverse walls 15 and 16 constituting a first and a second transverse wall. The transverse wall 16 extends between end edges 18 and 17 of the top wall and bottom wall, respectively. The transverse wall 15, extends from the opposed end edge 19 of the top wall 13 and the end edge 20 of the bottom wall 14. An attachment panel 21 secures the outer marginal edge portion 22 of the transverse wall 15, by means of glue applied to the attachment panel 21, and the marginal edge portion 22.

An article retaining panel 25, extends from a respective side edge 26 of the bottom and top walls 14 and 13. The article retaining panel 25 is inclined inwardly between the bottom and top wall and comprises an article retaining panel section 27 and a pressure applying panel section 28. The panel retaining section 27 extends angularly inwards towards the center of said carrier, from its respective side edge 26 along a first section 29. A second section 30 is formed integrally with the first section 29 and extends angularly inwards and towards its respective one of the bottom or top wall 14 or 13. The pressure applying panel 28 protrudes from an end edge of the second section 30 and extends beneath at least a portion of the first section 27 and angularly inwards towards the edge 26. An end margin 31 is provided adjacent the free end of the section 28 and is secured adjacent the edge 26 to the inside surface 32 of its respective one of the bottom or top walls 14 or 13.

As can be seen more clearly from FIG. 3, when the articles 50 are inserted into the carrier, the pressure applying panel section 28 will move upwardly against the inner surface 32 of the top panel 14, to provide a double walled panel adjacent one end of the article 50. This double wall panel is also provided adjacent the other end of the article as can be seen from the figure. Thus, with the articles inserted into the carrier, the bottom and top walls 14 and 13 are substantially formed of double layers of cardboard thus, adding to the strength of the package below and above the articles.

As shown more clearly in FIGS. 1 and 2, the article engaging panel section 27 is provided with article retaining cavities 35 which are spaced apart and in transverse alignment with the cavities 35 in an opposite retaining panel 25, whereby an article, such as a glass 50, may be removably secured between vertically aligned pairs of cavities. As can be seen the wall section 36 between the cavities 35 each constitute article retention ribs between the cavities. An article 50 is retained within the package and between aligned pairs of cavities by frictional engagement exerted by the ribs 36 and by axial pressure applied by the pressure applying panel section 28 which is generally angulated inwardly of its respective bottom or top wall 14 or 13 applying inward pressure in the direction of the arrows 37 as illustrated in FIG. 3. The configuration or contour of the cavities 35 depends on the shape of the articles being carried. In the particular case illustrated in FIG. 2, the cavities 35 of both article retaining panels 25 on a respective side of the bottom wall are smaller than the apertures 35 in the article retaining panels 25 of the top wall. Of course, the bottom and top wall herein defined are not necessarily the top or bottom of the package as the carrier may be formed inversely, that is, with the bottom wall 13 being in the position of the top wall and vice versa.

In order to make the article carrier easily transportable, a carrier tab 38 may be formed in each of the transverse walls 15 and 16. The carrier tabs 38 are each formed by cutting the outline of a finger inserting opening 39 and a retention rib 40 formed therewith whereby the tab 38 can be easily pushed into the inside of the carrier from the transverse walls when the finger is inserted. The tab is also designed to prevent handles from adjacent articles, such as "beer mugs", from displacement and damage when the package is manipulated.

The blank is illustrated in FIG. 2 and as can be seen the entire carrier is formed from a single sheet of paper stock or other foldable material and no external panels are required to be secured to the blank to form the carrier. All of the phantom lines illustrate a fold line and delineate all of the panels or securing end margins. Also, all of the fold lines extend parallel to one another and to the side edges 26 of the top and bottom walls or transversely thereto. Also, the bottom, top and transverse walls 14, 13 and 16 have opposed side edges 26 for the top and bottom wall and 26' for the transverse walls extending on a common axis on each side of the carrier 10 and further extending parallel to each other. Each of the article retaining panels 25 have parallel side edges 25' extending transversely from a respective end of the side edge 26 of a respective bottom or top wall. An end edge 25'' extends between the side edges 25' and parallel to the side edges 26 or 26'. Also, the outer end edges 15' and 20 of the transverse wall 15 and the top wall 13 are also parallel to each other and transverse to the side edges 26 and 26'.

The article carrier 10 is made by cutting a blank outline of the carrier 10 as illustrated in FIG. 2 and making the fold lines between all of the walls, panel sections, and the securing of end margins, as described hereinabove. Glue is then applied to the backside of the securing end margins 31 of each article retaining panel 25 and to the backside of the attachment panel 21. The securing end margins 31 of each panel 25 is then folded on its fold line 31' inwardly towards the top or bottom wall. The pressure applying panel fold line 28' and the fold line 27' delineating the first and second section of the article engaging panel 27 as well as the fold line 26'' of the side edge 26 are also folded on a common side towards the top or bottom walls. The backside of the securing end margins 35 are then secured, by means of glue, on the bottom or top wall whichever one it is associated with, adjacent the side edges 26 on said common side. The transverse walls 15 and 16 and the attachment panel 21 are then folded towards the common side at the fold lines 20, 17, 18 and 19 with the backside of the attachment panel secured adjacent the outer end edge 15' of the transverse wall 15 on the said common side. Thus, there is formed the article carrier 10 of the present invention. The above method is a preferred one and it is foreseen that the method of assembly can be altered by applying the glue to the various margins at a different stage in the folding operation. Also, after the package is assembled it may then be conveyed automatically to a machine which inserts the articles into the package.

It can be seen that the article carrier of the present invention can be completely automatically made and the contents inserted therein without manual intervention by an operator. Also, the package provides total visibility of the goods carried thereby and the articles may be removed from the carrier and placed back therein without destruction of the carrier. Still further, the carrier of the present invention is strengthened in the bottom and top wall sections thereof.

In FIG. 2 there is illustrated a further embodiment of the article carrier 10 in that the transverse walls 15 and 16 may be provided with reinforcing extension panels 15'' and 16', as shown in phantom lines. These panels 15'' and 16' are of substantially rectangular configuration and provide reinforcement along the vertical plane of the walls 15 and 16 by folding them on the common side of the blank, that is, on the surface internally of the carrier when assembled. The panels 15'' and 16' are retained in this position by the side edges 25' of the article retaining panels 25 when in their article retaining position as illustrated in FIG. 1. Of course, the tabs 38 are configured not to interfere with the panels 15'' and 16'.

Some further advantages of the panels 15'' and 16' are that it permits the blank to have only one surface thereof printed or coated with an esthetic coating as when the panels 15'' and 16' are in position and articles retained in the carrier, substantially only one side surface of the carrier blank is visible. Still further, the panels 15'' and 16' eliminate some of the wasted stock when the blank is formed.

I claim:

1. An article carrier blank comprising a single sheet of paper stock of other foldable material defining a series of walls having parallel end edges and fold lines formed along a common axis on each side thereof, said series of walls comprising a first transverse wall, a top wall, a second transverse wall, a bottom wall and an attachment panel, all in series; an article retaining panel adjacent each side edge of said bottom wall and said top wall, each said article retaining panel having an article retaining panel section connected to and extending adjacent said side edge and a pressure applying panel section outwardly of said article retaining panel section and integrally formed therewith, an outer securing end margin integrally formed with said pressure applying panel section and extending outwardly thereof, said article retaining panel section being formed of a first and second section, spaced apart openings in said article retaining panel sections constituting article retaining cavities; said wall panels, section and securing end margins being defined by substantially parallel and transverse edges or fold lines.

2. An article carrier blank as claimed in claim 1 wherein a carrier tab is formed in each said transverse wall, said tab being formed by cutting the outline of a finger inserting opening and a retention rib integral therewith and attached to said transverse wall.

3. An article carrier blank as claimed in claim 1 wherein each said article retaining panels have parallel side edges extending transversely from a respective end of said side edge of a respective bottom or top wall, and an end edge extending between said side edges and parallel to said bottom or top wall side edges.

4. An article carrier blank as claimed in claim 1 wherein there is further provided substantially rectangular reinforcing panels extending from side edges of said first and second transverse walls.

5. An article carrier having two opposed open sides, said carrier comprising a bottom and a top wall spaced apart in substantially parallel relationship by two transverse walls extending between opposed end edges of said bottom and top wall, an article retaining panel extending from each side edge of both said bottom and top walls and substantially transversely of said transverse walls and extending inwardly between said bottom and top walls, said article retaining panel including an article retaining panel section and a pressure applying panel section, article retaining cavities formed in each article retaining panel section and defining retention ribs therebetween, and each of said pressure applying panel sections extending from a side edge of its respective panel section and extending between at least a portion of said cavities in said article retaining panel and its corresponding top or bottom wall, each of said pressure applying panel sections extending normally angularly with respect to said bottom or top wall from an end margin thereof and being secured adjacent a respective side edge of said bottom or top wall, said cavities being in substantially vertical alignment with associated cavities in an opposite retaining panel whereby an article may be removably secured between vertically aligned pairs of cavities by frictional engagement by said ribs and by inward pressure applied between the ends of said article by said pressure applying panel section of each article retaining panel.

6. An article carrier as claimed in claim 5, wherein said article retaining panel section includes a first section extending angularly inwards from said respective side edge, and a second section formed integrally with said first section and extending angularly inwards and toward a respective one of said bottom or top walls.

7. An article carrier as claimed in claim 6 wherein said article retaining cavities are formed in said first and second sections of said article retaining panels.

8. An article carrier as claimed in claim 5 wherein said pressure applying panels extend substantially over the inner surface of both said panels when articles are retained by said carrier thus forming a top and bottom wall of double thickness material.

9. An article carrier as claimed in claim 5 wherein said carrier is formed from a single sheet of paper stock or other foldable material with said walls and panels integrally formed.

10. An article carrier as claimed in claim 5 wherein reinforcing panels are formed integrally with each said transverse walls, said reinforcing panels each being constituted by a panel extending along a vertical side edge of said transverse wall and disposed over a portion of an inner surface of said transverse wall substantially between said opposed end edges of said bottom and top wall and retained in such position by side edges of associated ones of said article retaining panels whereby the planar surface of said reinforcing panel lies in a plane substantially parallel to the plane of its respective transverse wall.

* * * * *